US005839671A

United States Patent [19]

Sand et al.

[11] Patent Number: 5,839,671

[45] Date of Patent: Nov. 24, 1998

[54] DEVICE AND METHOD FOR COMMINUTION

[75] Inventors: John Sand, West Vancouver; Jon Emmerson Martin, Surrey; Jeremy Jonathan Clarke-Ames, Richmond, all of Canada

[73] Assignee: Spectrasonic Disintegration Equipment Corp., Richmond, Canada

[21] Appl. No.: 732,979

[22] Filed: Oct. 19, 1996

[51] Int. Cl.[6] ..... B02C 13/00

[52] U.S. Cl. ..... 241/24.1; 241/27; 241/79.1; 241/152.2

[58] Field of Search ..... 241/24.1, 27, 79.1, 241/152.2, 275

[56] References Cited

U.S. PATENT DOCUMENTS

| | | | |
|---|---|---|---|
| 2,474,314 | 6/1949 | Koehne | 241/4 |
| 2,562,560 | 7/1951 | Macartney | 241/278.2 |
| 3,155,326 | 11/1964 | Rhodes | 241/275 X |
| 3,231,203 | 1/1966 | Hardinge et al. | 241/24.1 |
| 3,312,403 | 4/1967 | Zifferer | 241/24.12 |
| 3,552,662 | 1/1971 | Grob | 241/41 |
| 3,993,256 | 11/1976 | Brewer | 241/186.5 |
| 3,995,784 | 12/1976 | de los Santos Izquierdo | 241/275 |
| 4,013,233 | 3/1977 | Nylund | 241/80 |
| 4,556,175 | 12/1985 | Motoyama et al. | 241/57 |
| 4,662,571 | 5/1987 | MacDonald et al. | 241/81 |
| 4,739,937 | 4/1988 | Carpenter, Jr. et al. | 241/79.1 |
| 5,184,781 | 2/1993 | Andela | 241/62 |
| 5,195,695 | 3/1993 | Ondush et al. | 241/38 |

*Primary Examiner*—John M. Husar
*Attorney, Agent, or Firm*—Paul A. Guss; Mark M. Yang

[57] ABSTRACT

A device for comminuting raw materials like glass, rock, rubber buffings and the like, is disclosed. Raw material is propelled outwardly towards violent impact against a circular wall and then lifted by rapidly rising air for separation and possible return for further propelling outwardly towards impact against the circular wall.

13 Claims, 13 Drawing Sheets

DEVICE AND METHOD FOR COMMINUTION

FIELD OF THE INVENTION

This invention relates to the comminution of raw materials like wood chips, glass and rocks into fine powder.

BACKGROUND OF INVENTION

Numerous attempts have been made for comminuting raw material into fine powder. One problem with such attempts is their susceptibility to jamming and their inability to produce uniform results.

SUMMARY OF INVENTION

There is disclosed a device for comminuting raw material comprising: (a) a pan with a bottom and circular interior wall centered about a central axis; (b) a lid profiled to engage tightly said pan at their respective peripheries, whereby said pan and said lid define a comminution chamber centered about said central axis; (c) input means, located upstream of said comminution chamber, for receiving and guiding the raw material to said comminution chamber; (d) a first longitudinal blade disposed rigidly downwardly from said lid, extending outwardly from said central axis; (e) propelling means, disposed within said comminution chamber, for propelling the raw material from input means radially towards impact against said blade and then against said pan wall; (f) forced air flow means for creating an upward flow of air to lift raw material after impacting said pan wall, out of said comminution chamber; and (g) output means for outputting the raw material so lifted.

There is also disclosed a device for comminuting raw material comprising: (a) a pan with a bottom and circular interior wall centered about a central axis; (b) a lid profiled to engage tightly said pan at their respective peripheries, whereby said pan and said lid define a comminution chamber centered about said central axis; (c) input means, located upstream of said comminution chamber, for receiving and guiding the raw material to said comminution chamber; (d) a first longitudinal blade disposed rigidly downwardly from said lid, extending radially from said central axis; (e) a plurality of impeller blades for sucking the air inwardly toward the central axis; (f) a plurality of scythe blades rigidly attached to said plurality of impeller blades; (g) a plurality of stator blades rigidly attached to bottom of said pan; (h) rotating means to rotate said plurality of scythe blades over said plurality of stator blades; (i) forced air flow means for creating an upward flow of air to lift raw material after impacting said pan wall out of said comminution chamber; and (j) output means for outputting the raw material so lifted.

BRIEF DESCRIPTION OF DRAWINGS

Advantages of the present invention will become apparent from the following detailed description taken in conjunction with preferred embodiments shown in the accompanying drawings, in which.

DETAILED DESCRIPTION OF THE PREFERRED EMBODIMENTS

A device for comminuting raw material will be explained and thereby a method of comminuting raw material will become evident as the operation of the device is explained.

Figure 1:
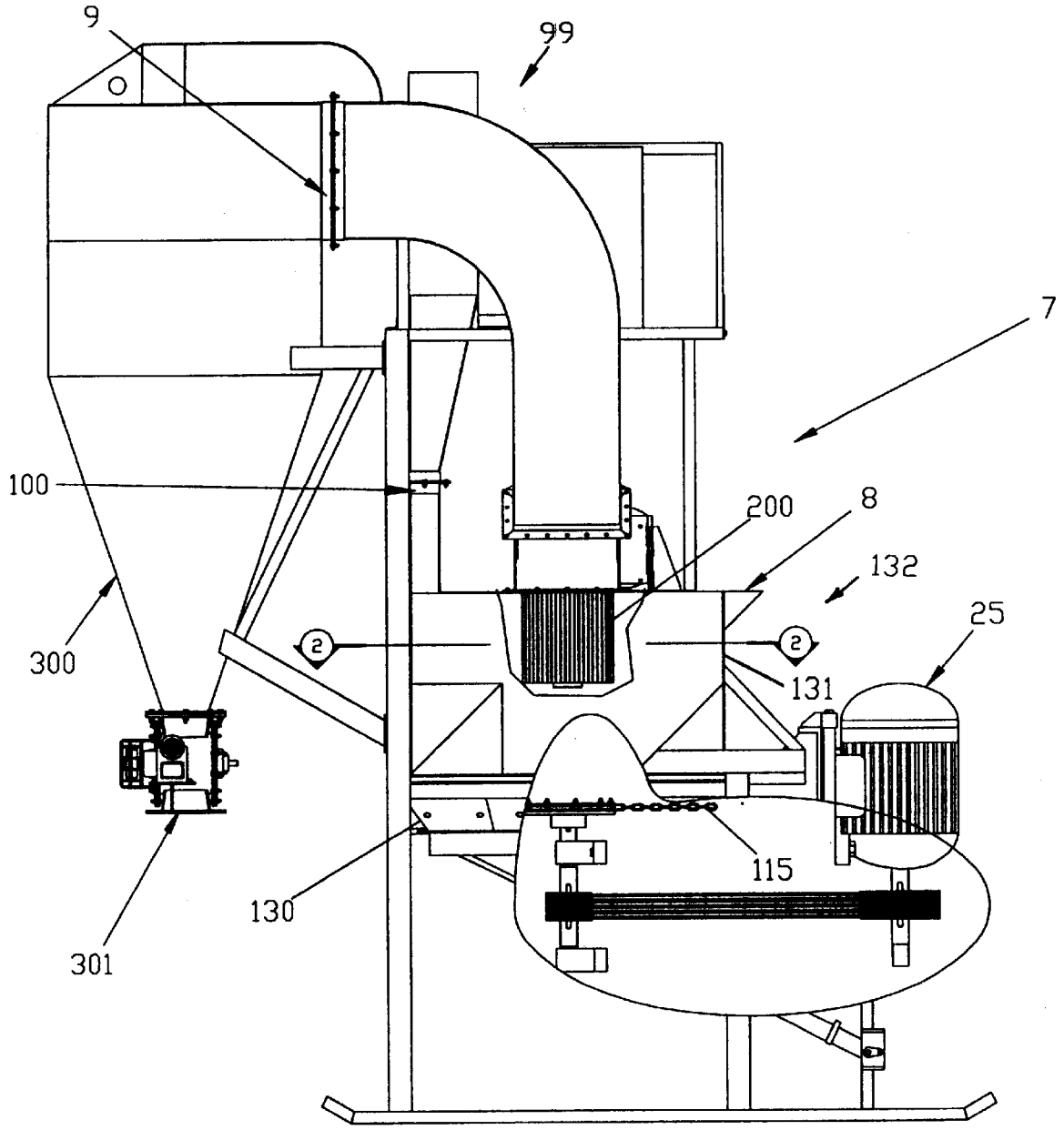
FIG. 1 is a side view, partially broken away, of a device incorporating an embodiment of this invention.
Figure 3:
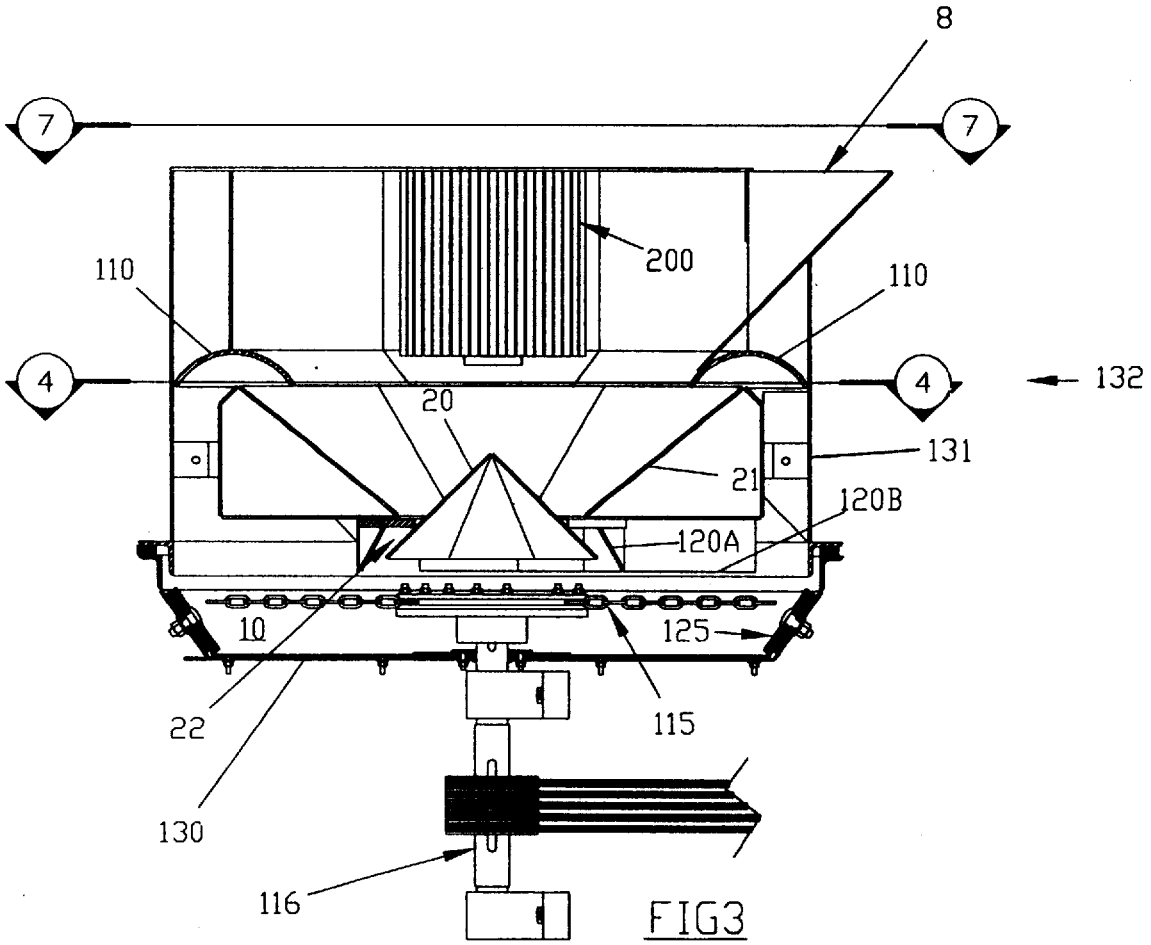
FIG. 3 is a sectional side view taken along line 3—3 of FIG. 2.

As seen in FIGS. 1 and 3, comminution device 7 has input chute 8 for raw material and an output 9 for comminuted raw material. Main body 132 of device 7 is the combination of pan 130 and lid assembly 131. Conventional forced air means or blower 99 is connected to main body 132 at inlet 100. The bottom of lid assembly 131 and pan 130 form comminution chamber 10 where the comminution occurs.

Downstream of comminution chamber 10 are output 9, conventional cyclone 300 and output gate valve 301, and they, with conventional input gate valve (not shown) connected to input 8, maintain intrinsic air pressure of the system. Blower 99 recycles air from cyclone 300.

Main body 132 has a central axis about which central shaft 116 turns and about which separator 200 and comminution chamber 10 are centered.

Figure 2:
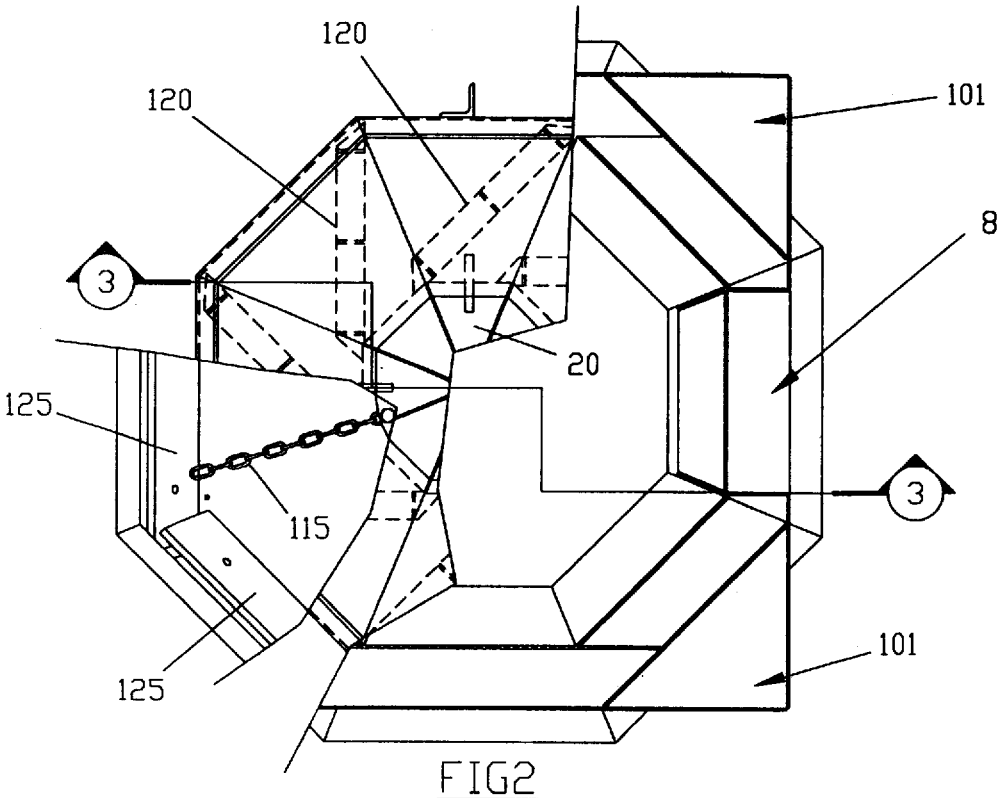
FIG. 2 is a sectional plan view taken along line 2—2 of FIG. 1.
Figure 4:
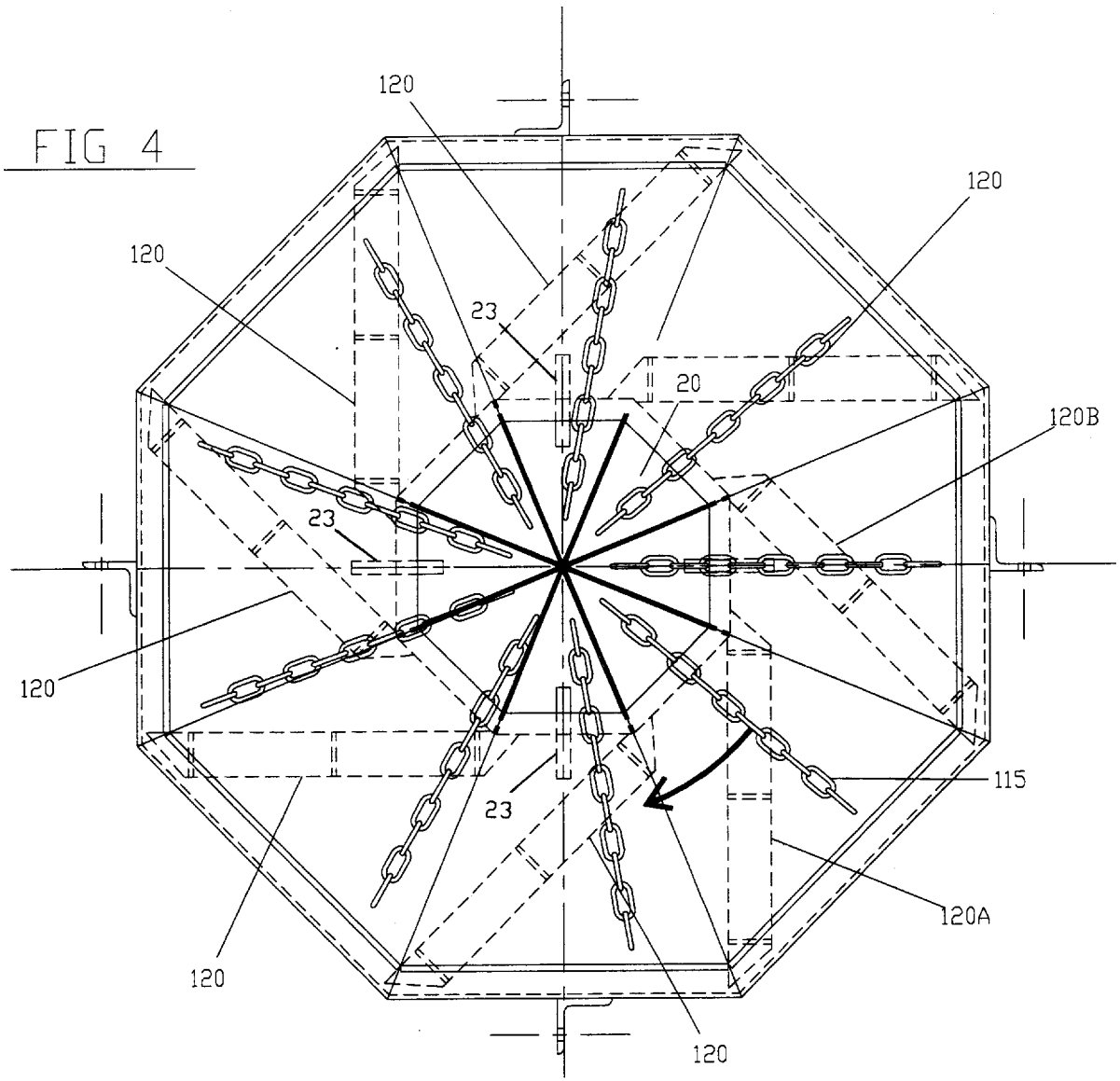
FIG. 4 is a plan view taken along lines 4—4 of FIG. 3.

As shown in FIGS. 2 to 4, deflecting cone 20 is a hollow, inverted and open cone and is disposed by struts 23, about the central axis, with apex pointing upwardly. Cone 20 is disposed centrally within the hollow of inverted, hollow frusto-conical cone 21, creating an annulus of separation 22 for the raw material from input 8 to fall through.

At the bottom of lid assembly 131 is a metal plate to which eight shear blades 120 are rigidly disposed tangentially and equispaced from a central octagonal hub centered on the central axis. Blade 120 is disposed about 61° from the horizontal downwardly in the circular direction of rotation of chains 115 (as indicated in FIG. 4). Blade 120 (viewed from the side as shown in FIG. 3) has an inner edge 120A (proximate annulus 22) and a bottom edge 120B.

Pan 130 is hinged to one side of lid assembly 131 and is provided with sealing features so that when it is raised to meet the bottom of lid assembly 131 at their respective peripheries and secured by fasteners, an air-tight seal is created for comminution chamber 10. Pan 130 may be opened for cleaning and replacing blades 120 and like activities. For economy of illustration, the hinging mechanism, sealing and fasteners are conventional and are not shown.

Figure 5:
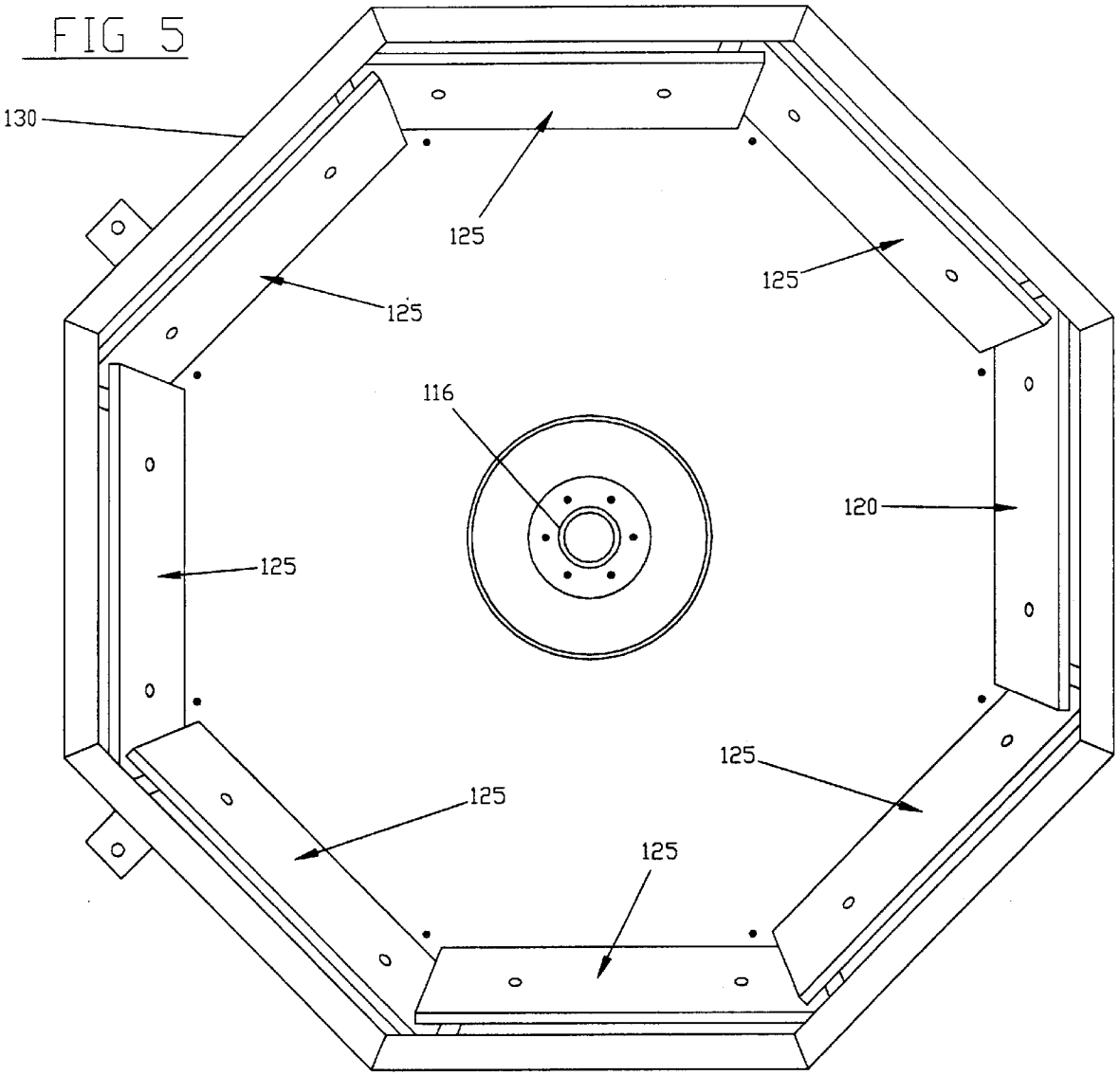
FIG. 5 is a plan view of the pan of the device of FIG. 1.
Figure 11:
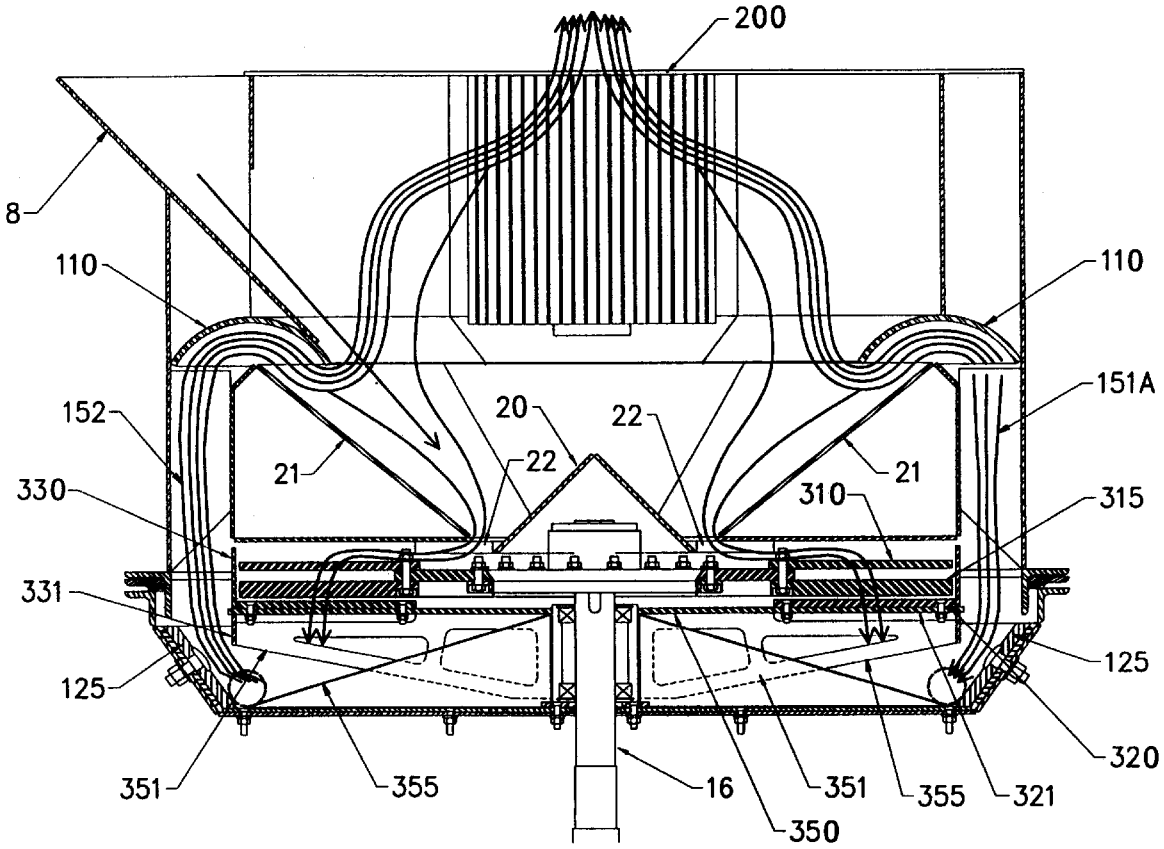
FIG. 11 is a sectional view of a device incorporating another embodiment of this invention.

As best shown in FIG. 5, eight wall plates 125 are disposed circumferentially about the interior periphery of pan 130 to form the interior wall thereof. Each plate 125 is disposed at about 45° from the horizontal bottom of pan 130. The interior of pan 130 is essentially circular and precisely octagonal and can be made more smoothly circular by conventional means (for example, using more and smaller wall plates). To avoid corners where raw material may lodge, plates 125 may be bevelled on their sides and top to produce a flush surface with respect to each other and the bottom of pan 130 (as shown in FIG. 11).

Nine multi-link chains 115 are conventionally secured at their respective inner ends to central shaft 116 but are otherwise loose to be rotated quickly. Chains 115 are conventional chains with thirteen 13 links, each link of about 2" long, so that the length of a chain 115 is about 22".

Motor 25 rotates central shaft 116 through conventional belt and pulley arrangements. The chains 115 spin with tip speeds of about 500 mph, to form a spinning circular "curtain" of metal to move outwardly and accelerate the raw materials falling thereon from annulus 22.

It has been found that nine chains 115 is a suitable number for a comminution chamber 10 dimensioned where pan 130 is about 4' in diameter and 10" in height. Generally, it has been found that the greater the number of chains, the greater efficiency of comminution but this is subject to increased risk of entanglement of the chains when rotated.

Air is injected into device 7 through inlet 100 by blower 99, which can inject air in the order of 10,000 to 15,000 cubic feet per minute. To minimize the adverse effects of heating on the comminution process (described below), cooled air may be injected into the flow stream or the raw material may be precooled before being inputted into the input chute 8; both being accomplished by conventional means (not shown).

Raw material is dropped into input 8 and slides down to fall centrally through annulus 22 and to be then deflected outwardly by cone 20. The raw materials are then propelled outwardly as follows. The raw materials hit the circular "curtain" formed by rotating chains 115, and are then propelled outwardly centrifugally with great acceleration towards wall plates 125 of pan 130. The raw materials vertically and violently bounce between the curtain formed by spinning chains 115 and the bottom of lid assembly 131, and also horizontally impact violently against blades 120 as they move outwardly towards wall plates 125 of pan 130. The raw materials then impact violently against the wall plates 125 of pan 130 at high speeds. These violent impacts accomplish comminution of the raw material by shattering and similar disintegration.

Rotating chains 115 do not normally impinge on any part of comminution chamber (i.e. unless there is a collision with raw material which distorts temporarily the orbit of chains 15). Chains 115 rotate with clearance of about 2" from the bottom of pan 130, of about 1" from blades 120 and, (from the outer free tips of chains 115) of about 1" from plates 125.

Although chains 115 are shown, similar forms of agitator elements are possible (such as blades and disks with perforations and protuberances), as long as they are useful when rotated to impact violently the raw material and to propel outwardly.

The flow of air is shown in FIGS. 7 to 10, which (with the exception of FIG. 8) are simplified by omitting details not directly applicable to the illustration of a certain aspect of the air flow.

Figure 7:
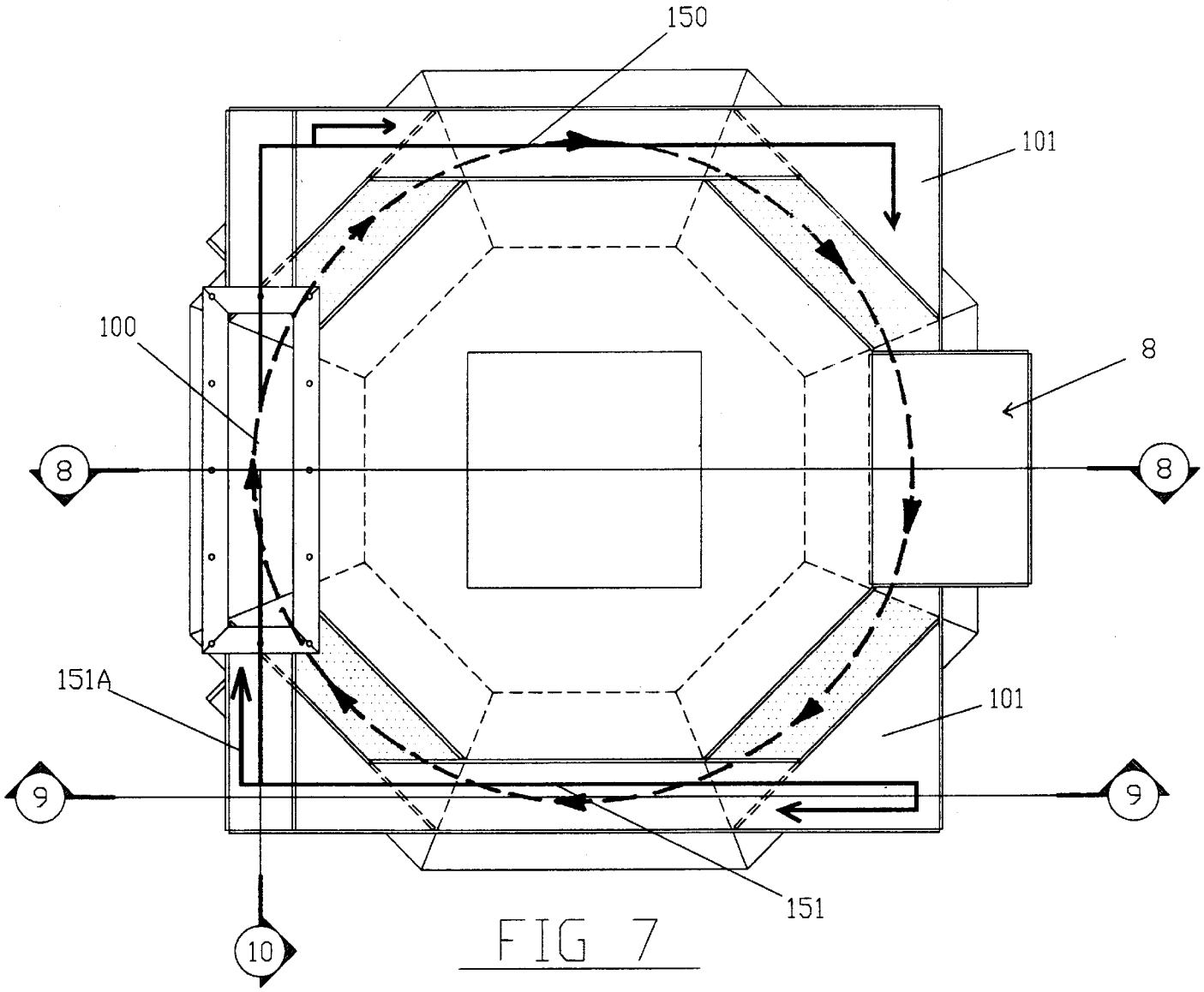
FIG. 7 is a plan view of the flow of injected air seen from line 7—7 of FIG. 3.

Forced air enters comminution chamber 10 from blower 99 through inlet 100. The air is then channelled into two downward flows (150 and 151) and then four flows travelling downwardly through four vertical corners equispaced about pan 130. The four jets of air are directed equispaced and downwardly approximately tangential to the circular assembly of wall plates 125 of pan 130, as seen in FIG. 7. Thus a fast moving "torus" or toroidal pattern of air is created within pan 130 (shown in plan cross section in dotted arrow in FIG. 7 and in side cross section by the dotted circle in FIG. 11). The toroidal flow pattern dissipates approximately as follows. The air partially circles pan 130 and then rises to create a fast moving annular column of air along upward flow lines 152 rising along the inside the side wall of lid assembly 131 which carries therewith the raw materials after impact with pan wall plates 125.

For ease of illustration and understanding, downward flow 151 will be described below but downward flow 150 will not because it is similar to flow 151 except it is on the other side of the device.

Figure 9:
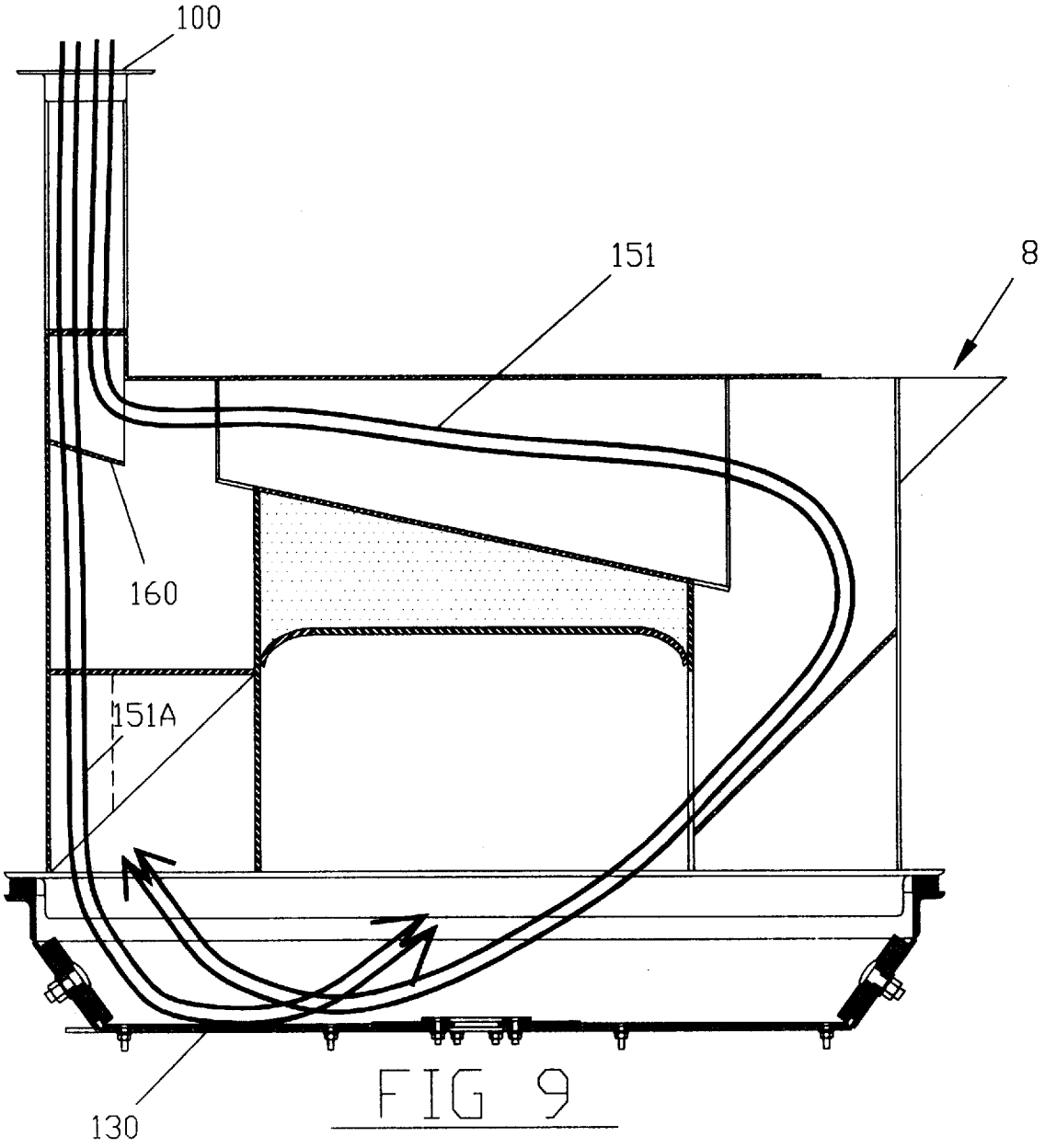
FIG. 9 is a sectional view of the flow of injected air seen from line 9—9 of FIG. 7.
Figure 10:
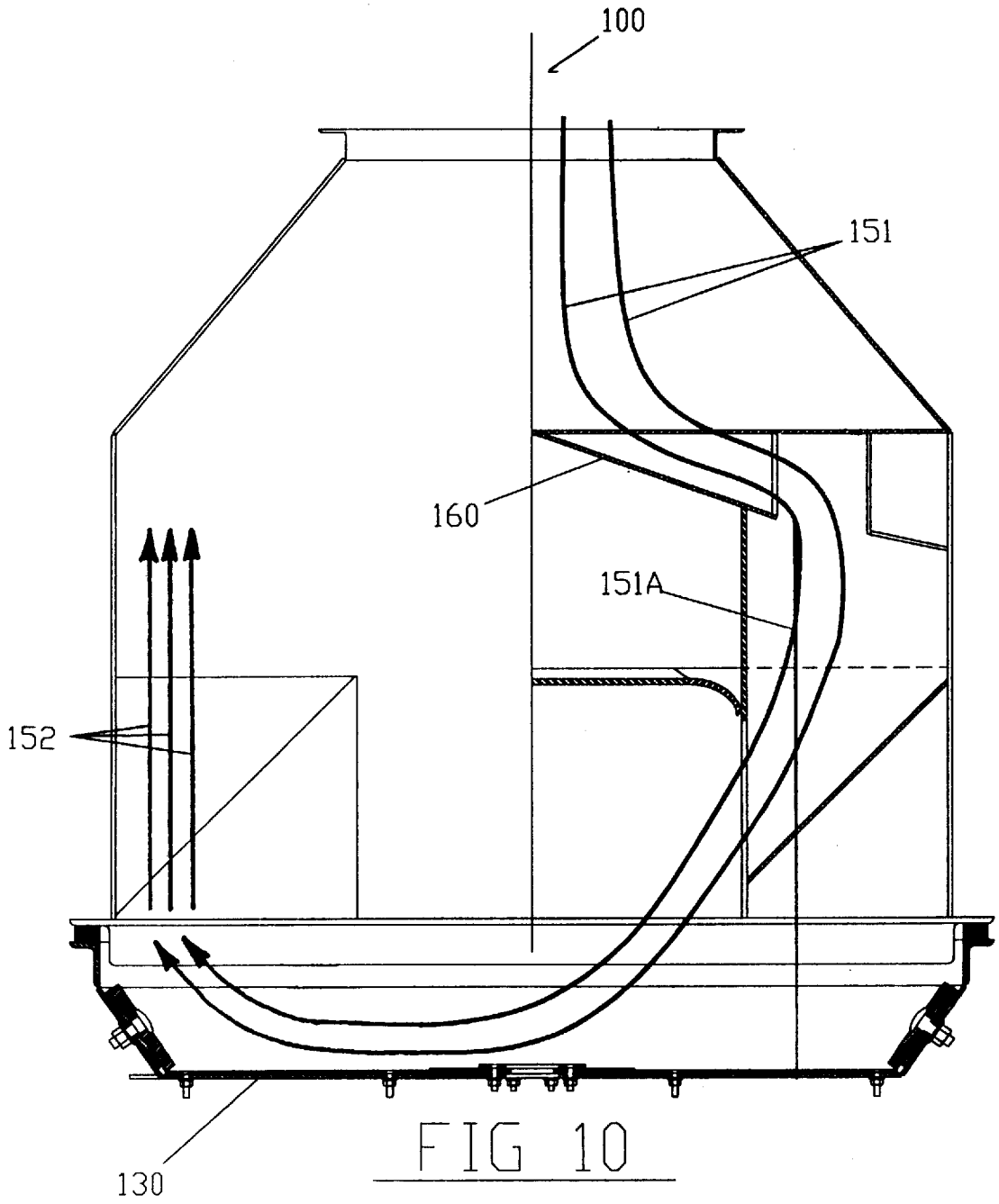
FIG. 10 is a sectional view of the flow of injected air seen from line 10—10 of FIG. 7.

Flow 151 is channelled to flow 151 and 151A (as seen in FIGS. 7, 9, and 10). The materials, after impacting said pan 130 wall, are swept upwardly along the walls of lid assembly 131, along flow lines 152 above annulus 22 and then redirected inwardly and downwardly by redirectional turn 110 towards annulus 22 (i.e. directed back to comminution chamber 10). Turn 110 is the upper half of a torus tube which extends about the periphery of the lid assembly 131 and operates to filter the material as follows. Some of the heavier material descends through annulus 22 to enter comminution chamber 10 again, as represented by flow lines 153, to participate in another cycle of comminution. The lighter material (in spite of being directed downwardly by turn 110) rises towards separator 200. Some of the material does not pass through separator 200 falls down (as will be explained below) and joins the heavier material, as indicated by flow lines 153. Also, the centrifugal effect of turn 110 on the material also serves to move the heavier particles from the lighter particles of the material to the outside, i.e. produces a separating effect between heavier and lighter particles of the materials. The closer the inner edge of turn 110 is to annulus 22 (i.e. the longer downwardly the material must travel before being able to rise), the finer the filtering effect.

Figure 8:
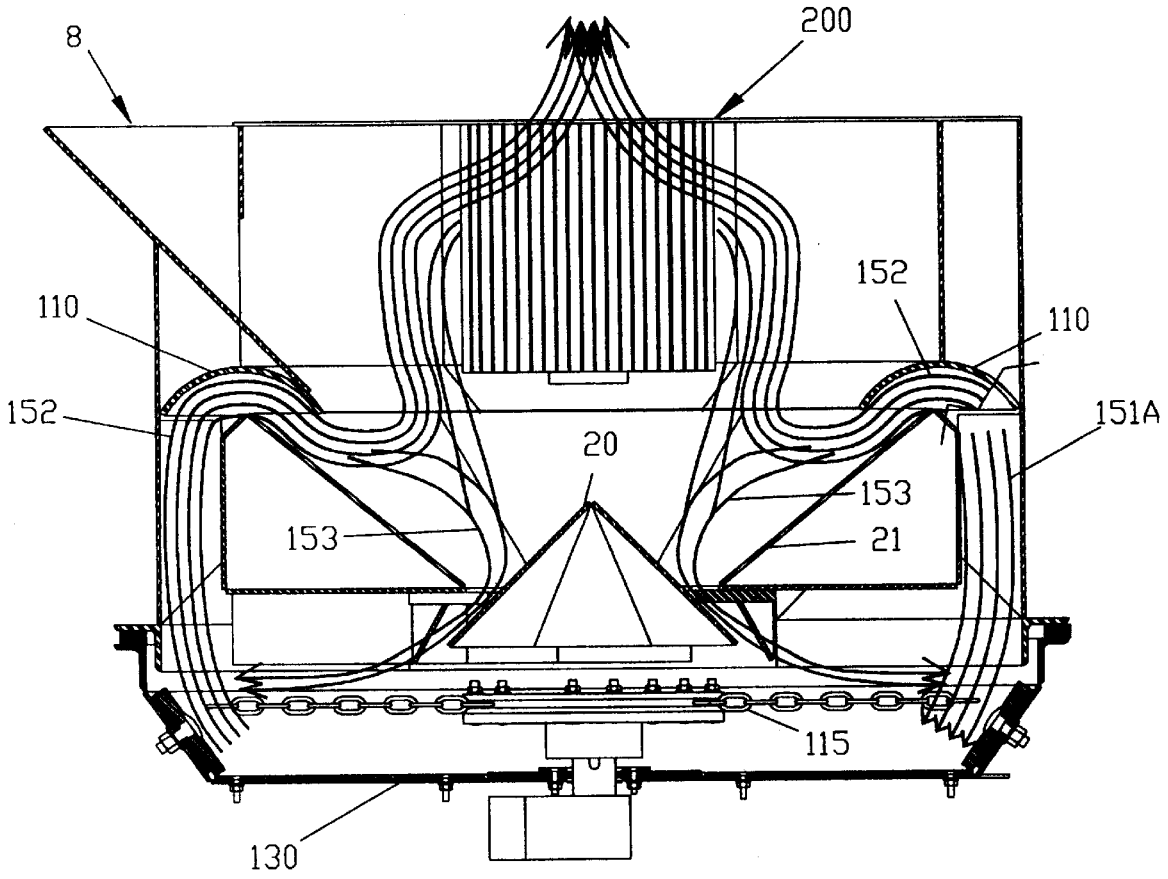
FIG. 8 is a sectional view of the flow of injected air and raw materials seen from line 8—8 of FIG. 7.

As shown in FIG. 8, separator 200 separates from the raw material rising along flow lines 152 from the periphery of pan 130 which have not dropped into annulus 22. Raw material of a prescribed particle size or less move into the interior of separator 200 and proceed to output 9. Material whose particle size is larger than said prescribed particle size, bounce back from separator 200 and into annulus 22, as shown in flow lines 153.

Figure 6:
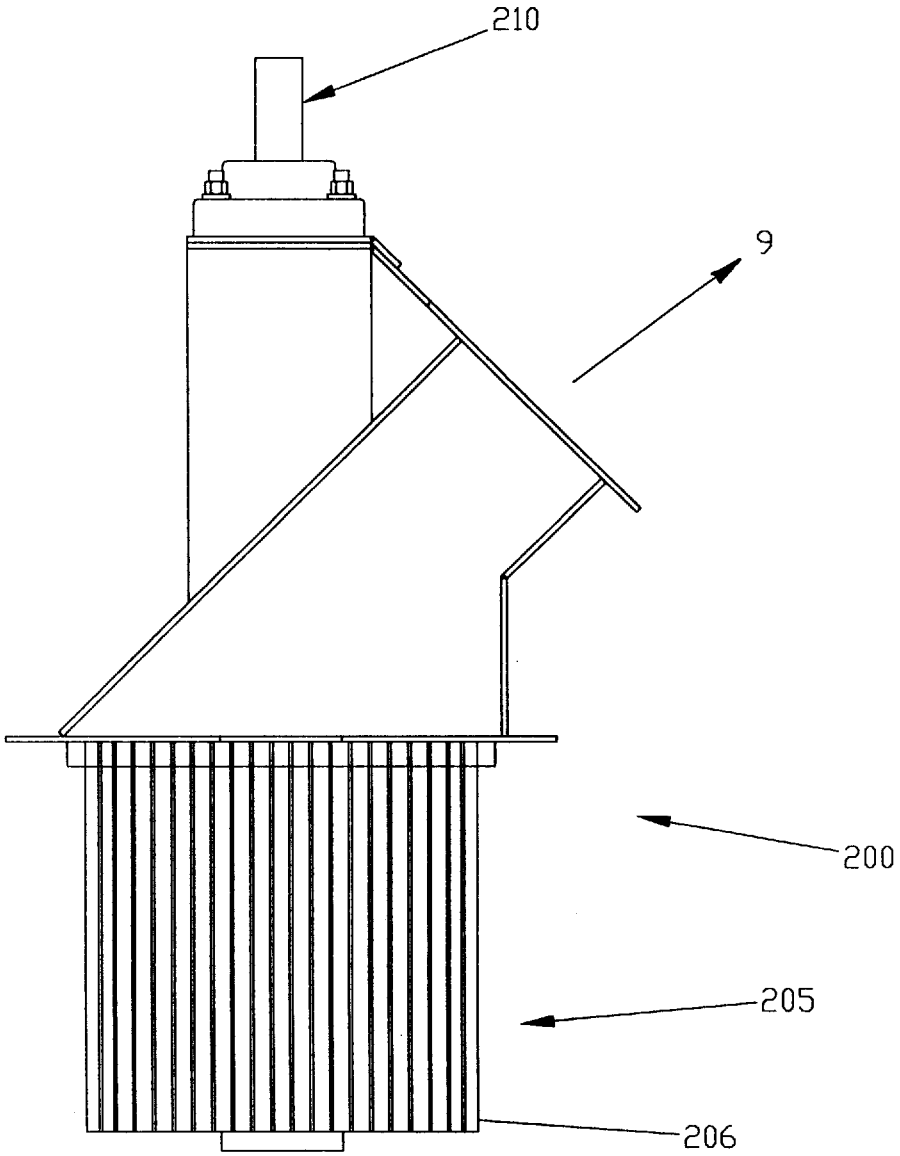
FIG. 6 is a side view of the separator of the device of FIG. 1.

As shown in FIG. 6, separator 200 is of a conventional trommel construction and includes a squirrel cage 205 which is rotated by variable speed motor 210. Cage 205 has thirty six, circumferentially spaced and equispaced vertical blades 206. Blade 206 is a 18"×1"×⅛" rectangular plate and each blade 206 is disposed about 5° from the radial against the direction of rotation. By adjusting the speed of motor 210, the desired particle size can be obtained. The faster the rotation, the finer the output particles will be emerging from separator 200 towards output 9.

Raw materials include glass, oyster and crab shells, cement clinker rock, quartz rock and wood chips. For example, cement clinker rock of 1.5" diameter has been comminuted to 500 mesh particles on two cycles through comminution chamber 10. Quartz rock of 1.5" diameter has been comminuted to 450 mesh particle on two cycles. Wood chips of size 1"×2"×¼" has been comminuted to 40 mesh in one cycles and 85 mesh in two cycles. Dolomite of ¾ inch pebbles can be continuously processed. Most of the dolomite raw material is outputted as 350 mesh powder within the first cycle. Raw materials include also waste materials (including heterogenous materials found in municipal and household garbage debris), where the comminuted result has less moisture content than the inputted raw material.

Blades 120 are made of AR QT 350 steel. Plates 125 are made of AR QT 350 steel. The links of chain 115 are made of hard steel which does not stretch, perhaps 70 grade steel.

Figure 12:
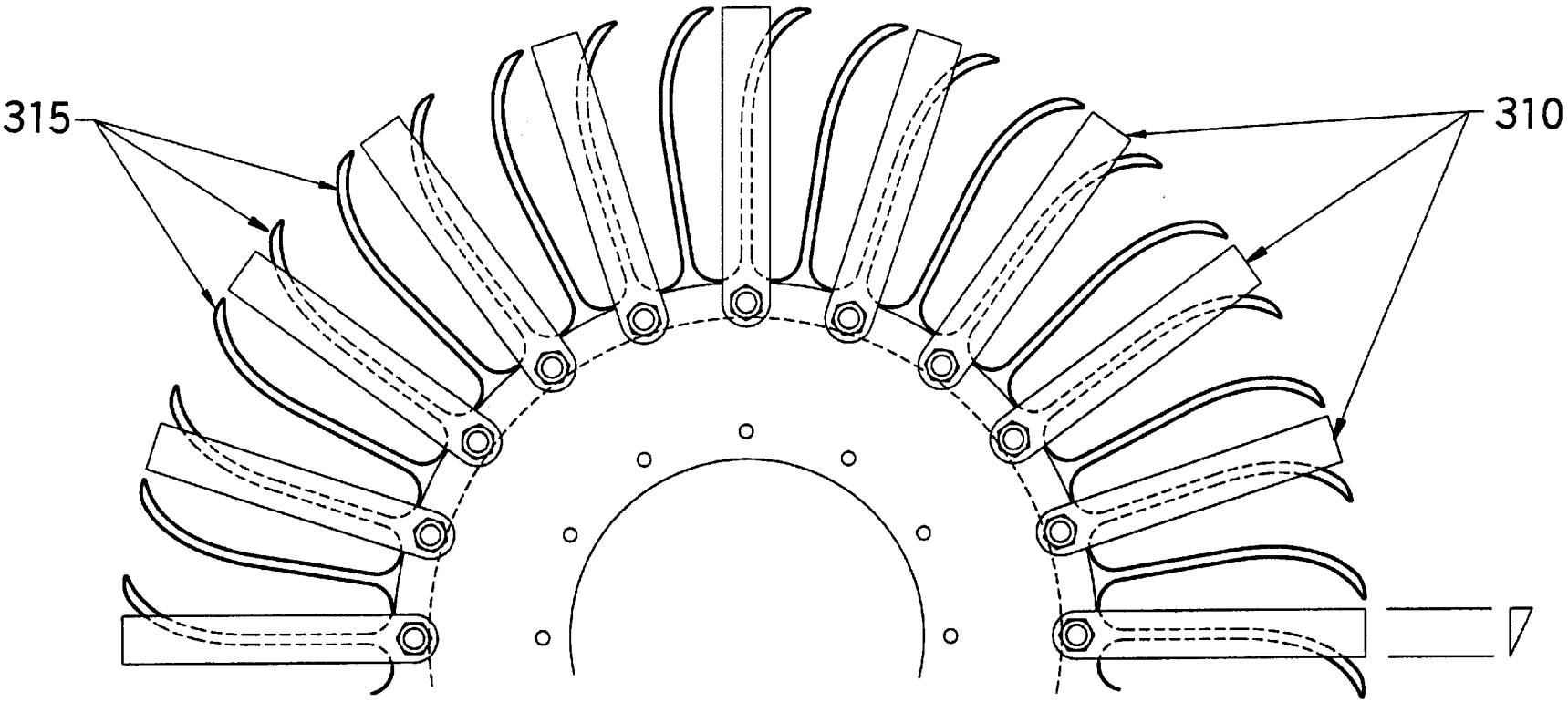
FIG. 12 is a truncated plan view of the impeller and scythe blade assembly of the device of FIG. 11.
Figure 13:
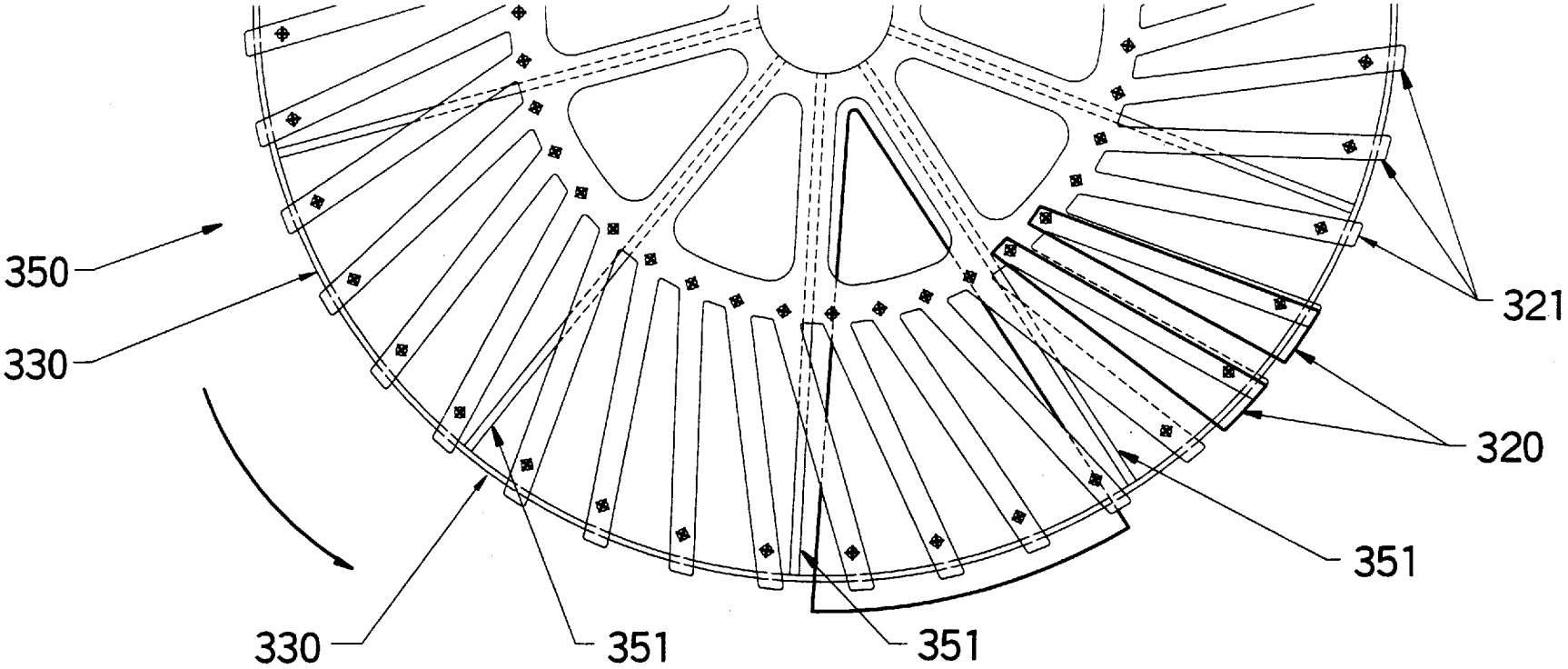
FIG. 13 is a truncated plan view of the stator blades of the device of FIG. 11.

Another embodiment of the invention is shown in FIGS. 11 to 13, in which the device of FIG. 11 basically corresponds to the device of FIG. 8, except that cone 20 is raised relatively and chains 115 are replaced with another structure (as will be explained next). Otherwise, the other components are identical and for economy of description, will not be described again.

Circular cradle 350 consists of forty rigid extensions or wings 321 radially extending from the center thereof (shown in truncated form in FIG. 13). Mounted rigidly to each wing 321 is a pie-shaped stator blade 320 (two of which are shown in FIG. 13).

Cradle 350 is mounted on a platform composed of eight radially extending shoulders or webs 351. A triangular wedge 355 is placed between each shoulder 351 (one such wedge 355 is shown in FIG. 13), so as to create a shallow cone, to guide the material falling thereon towards the periphery of pan 130 where the toroidal flow of circulating air is (as seen in side view in FIG. 11).

Twenty impeller blades 310 are rigidly connected to forty scythe blades 315, as shown in FIG. 12, and the impeller-scythe blades assembly thereof is rotated by central shaft 16). The outer tip speed of the scythe blades 315 (i.e. proximate the wall of pan 130) is about 250 mph. The assembly rotates above the stationary stator blades 320 with a small clearance, in the order of 1/32" or less. Impeller blade 310 may be a simple wedge (as shown in side view in FIG. 12), with apex pointed in the direction of rotation.

Mounted rigidly on the periphery of cradle 350 is upper circular skirt 330 and lower circular skirt 331. Upper skirt 330 prevents materials from escaping from the impeller-scythe blades assembly when rotating. Lower skirt 331 forces materials downwardly to join the toroidal pattern of air within pan 130, so as to obtain maximum speed and subsequent uplift of the column of rising air 152.

The air flow patterns are similar to those described with the embodiment of FIGS. 1–4 and will not be repeated for economy of description. One difference is the result of impeller blades 310. Instead of immediately contacting pan 130, air flow 151A is sucked inwardly towards the center of the impeller-scythe blades assembly by the rotating impeller blades 310. Material is caught by flow 151A and flows through the cutting and related disintegrating activity of scythe blades 315 rotating above stator blades 320. The raw material is then sucked upwardly with the rising column of air 152.

Except for the differences in components and air flow described above, the components, operation, air flow and general principles of the embodiment show in FIGS. 1–4 are the same as for this embodiment and are not repeated for economy of description.

It has been found with this embodiment that rubber raw material in the form of tire buffings and crumb rubber, can be comminuted to fine powder of less than 300 mesh particle size.

Impeller 210 blades are made of QT 100 steel and may be about 12" long. Scythe blades 215 are made of QT 360 steel and have a cutting length of about 16". Stator blades 220 may be made of a hard metal, like nickle-cadmium alloy with 65 Rockwell hardness. Stator blades 220 have length dimensions similar to scythe blades 215.

The actual dimensions of components, the number of blades, the number of links in the chain, the number of chains, the rotational speeds, the clearances of the chains within the comminution chamber and the like of components of representative examples of the invention are given above. It will be appreciated that they are given merely for purposes of illustration and are not limiting in any way. The specific parameters may be varied as long as the principles are respected. For example, the desired speed of the forced air is a function of the specific gravity of raw material and the rotational speed of chains. For another example, depending on the raw material, the number of blades and chains may be adjusted to produce optimal results.

While the principles of the invention have now been made clear in the illustrated embodiments, there will be immediately obvious to those skilled in the art, many modifications of structure, arrangements, proportions, the elements, materials and components used in the practice of the invention, and otherwise, which are particularly adapted for specific environments and operational requirements without departing from those principles. The claims are therefore intended to cover and embrace such modifications within the limits only of the true spirit and scope of the invention.

We claim:

1. A device for comminuting raw material comprising:

(a) a pan with a bottom and circular interior wall centered about a central axis;

(b) a lid profiled to engage tightly said pan at their respective peripheries, whereby said pan and said lid define a comminution chamber centered about said central axis;

(c) input means, located upstream of said comminution chamber, for receiving and guiding the raw material to said comminution chamber;

(d) a first longitudinal stationary blade disposed rigidly downwardly from said lid, extending outwardly from said central axis;

(e) propelling means, disposed within said comminution chamber adjacent said blade, for propelling the raw material from said input means to impact against said blade at a position inside and radially spaced from said pan wall and then outwardly against said pan wall;

(f) forced air flow means for creating an upward flow of air to lift substantially all of said raw material after impacting said blade and said pan wall, out of said comminution chamber; and (g) output means for outputting the raw material so lifted.

2. The device of claim 1 wherein said propelling means includes:

(a) an agitator element; and (b) rotating means, disposed axially along said central axis and to which said agitator element is attached, for rotating said agitator element circularly within said comminution chamber immediately under said blade, to thereby propel outwardly the raw materials upon contact therewith, towards impact against said blade and said pan wall.

3. The device of claim 2, wherein said agitator element includes a multi-link chain.

4. The device of claim 1, wherein said pan wall comprises a plurality of plates which are disposed circumferentially about the interior of said pan, and which are slanted outwardly and obliquely upwardly from said pan bottom.

5. The device of claim 4, further comprising a plurality of said blades disposed rigidly downwardly from said lid, extending radially from said central axis and disposed equispaced, with said first blade, about said central axis.

6. The device of claim 1, further comprising a separator disposed downstream of said comminution chamber, for separating said raw material emerging from said comminution chamber whereby those of a prescribed particle size are guided to said output means and those greater than the prescribed particle size are directed back to said comminution chamber.

7. The device of claim 6 further comprising redirection means, disposed upstream of said separator, for redirecting said heavier raw material emerging from said comminution chamber downwardly back into said comminution chamber, while permitting lighter raw material to rise towards said separator.

8. The device of claim 1, further comprising deflecting means associated with said input means and disposed upstream of said comminution chamber and said agitator element, for collecting centrally and then guiding raw materials from said input means into said comminution chamber, and then outwardly towards said pan wall.

9. The device of claim 8, wherein said deflecting means includes a first cone, being an inverted frusto-cone, and a second cone, with apex pointing up and centrally within the hollow of said first cone, to define an annulus of separation for the raw material to fall through to said comminution chamber and to guide raw material outwardly toward said pan wall.

10. The device of one of claims 1 to 9, wherein said forced air flow means includes a conduit disposed at the periphery of said comminution chamber downwardly to and tangentially to said circular pan wall, so that the forced air moves along said pan bottom in a toroidal-like pattern and then moves up the side walls of said comminution chamber as a hollow, circular cylinder of air and carries therewith the raw material which had dropped from said deflecting means and had been propelled by said propelling means and had impacted against said blade and said pan wall.

11. A device for comminuting raw material comprising:

(a) a pan with a bottom and circular interior wall centered about a central axis;

(b) a lid profiled to engage tightly said pan at their respective peripheries, whereby said pan and said lid define a comminution chamber centered about said central axis;

(c) input means, located upstream of said comminution chamber, for receiving and guiding the raw material to said comminution chamber;

(d) a plurality of impeller blades, rotatable centered about said central axis, for sucking the air inwardly towards said central axis;

(e) a plurality of scythe blades rotatably centered about said central axis;

(f) a plurality of stationary stator blades rigidly attached to said pan and centered about said central axis and lying in a plane vertically adjacent to the plane of rotation of said plurality of scythe blades;

(g) rotating means for rotating said impeller blades and for rotating said plurality of scythe blades past said plurality of stator blades, to thereby propel said raw material to impact against said stator blades at a position inside and radially spaced from said pan wall and then outwardly against said pan wall;

(h) forced air flow means for creating an upward flow of air to lift substantially all of said raw material after impacting said pan wall out of said comminution chamber; and (i) output means for outputting the raw material so lifted.

12. A method of comminuting raw material comprising the steps:

(a) inputting raw material along a central axis;

(b) extending a stationary blade outwardly from said central axis and disposing a wall around said stationary blade, an inner surface of said wall being proximate the distal end of said blade;

(c) creating an air flow rising from said wall;

(d) propelling the raw material to violently impact against said blade at a position inside and spaced from said wall and then outwardly against the surface of said wall;

(e) lifting substantially all of the impacted raw material by said rising air flow; and (f) separating the lifted raw material between lighter and heavier particles thereof and then directing the heavier particles to perform steps (d), (e) and (f) again while permitting the lighter particles to rise.

13. A device for comminuting raw material comprising:

(a) a pan with a bottom and circular interior wall centered about a central axis;

(b) a lid profiled to engage tightly said pan at their respective peripheries, whereby said pan and said lid define a comminution chamber centered about said central axis;

(c) input means, located upstream of said comminution chamber, for receiving and guiding the raw material to said comminution chamber;

(d) a first longitudinal blade disposed rigidly downwardly from said lid, extending radially from said central axis;

(e) a plurality of impeller blades, for sucking the air inwardly towards the central axis;

(f) a plurality of scythe blades rigidly attached to said plurality of impeller blades;

(g) a plurality of stator blades rigidly attached to a bottom of said pan;

(h) rotating means to rotate said plurality of scythe blades over said plurality of stator blades;

(i) forced air flow means for creating an upward flow of air to lift raw material after impacting said pan wall out of said comminution chamber; and (j) output means for outputting the raw material so lifted.

* * * * *